United States Patent [19]

Benthin

[11] 4,406,436

[45] Sep. 27, 1983

[54] HOLDING ELEMENT FOR MOUNTING BEARING PIECES

[75] Inventor: Johannes Benthin, Bremerhaven, Fed. Rep. of Germany

[73] Assignee: Suntec Sonnenschutztechnik GmbH, Bremerhaven, Fed. Rep. of Germany

[21] Appl. No.: 227,406

[22] Filed: Jan. 22, 1981

[30] Foreign Application Priority Data

Jan. 30, 1980 [DE] Fed. Rep. of Germany ..... 3003227

[51] Int. Cl.[3] ..... A47H 1/14

[52] U.S. Cl. ..... 248/262

[58] Field of Search ..... 248/62, 222.1, 262; 16/87 R, 93 D, 94 D, 95 D, 96 D

[56] References Cited

U.S. PATENT DOCUMENTS 3,129,751 4/1964 Weber ..... 160/345

3,927,437 12/1975 Ford ..... 160/345 X 4,240,178 12/1980 Miki ..... 16/93 D 4,299,008 11/1981 Burns ..... 16/95 D

*Primary Examiner*—William H. Schultz

*Assistant Examiner*—Ramon O. Ramirez

*Attorney, Agent, or Firm*—Michael J. Striker

[57] ABSTRACT

A holding element for mounting a bearing piece supporting a curtain and the like, has a holding and mounting member connected with one another by a plug connection having an axis of rotation, and two projections each provided on a respective one of these members and engageable in one of two recesses of the bearing piece. The holding element can be separated from the bearing piece by rotation about the above-mentioned axis without disengagement of the holding member from the mounting member. A gripping tongue is arranged on the holding member for rotation of the latter relative to the mounting member.

10 Claims, 5 Drawing Figures

HOLDING ELEMENT FOR MOUNTING BEARING PIECES

BACKGROUND OF THE INVENTION

The present invention relates to a holding element for mounting bearing rails or pieces, particularly for mounting a bearing piece for a curtain or the like.

Holding elements of the above-mentioned general type are known in the art. A known holding element has projections which are engageable in recesses provided in the bearing piece. Non-holding elements include a holding member constituted of sheet metal or synthetic plastic material and having angular construction. One leg of the holding element is provided with holes for mounting screws, whereas the other leg of the same is provided with projections for engaging in the recesses of the bearing piece. Such holding members are frequently designed as clamps, so that the bearing piece during mounting is inserted into the holding element with elastic deformation of the latter, and during dismounting can be released from the holding element by overcoming the material tension. The holding member with the above-described clamping action is utilized for bearing pieces with small loading.

SUMMARY OF THE INVENTION

Accordingly, it is an object of the present invention to provide a holding element which is substantially universal and provides for firm and force transmitting connection with the bearing piece for low as well as for high loads, and which guarantees an easy mounting of the bearing element in narrow places practically without a tool.

It is also an object of the present invention to provide a holding element which allows for releasable mounting of the bearing piece so that the latter can be mounted easily and fast, on the one hand, and can be dismounted also easily and fast, on the other hand.

In keeping with these objects and with others which will become apparent hereinafter, one feature of the present invention resides, briefly stated, in a holding element which comprises a holding member and a mounting member connected with one another by a plug connection, and is provided with means for connecting the holding member and the mounting member with the bearing piece, the connecting members including one projection arranged on the holding member and engageable in one of the recesses of the bearing piece, and another projection arranged on the mounting member diametrically opposite to the one projection and engageable in the other recess of the bearing piece.

When the holding element is designed in accordance with the present invention, it provides for strong and force transmitting connection between the holding element and the bearing pieces for both low loads and high loads. The holding element is easily mounted and dismounted and can be arranged in narrow places without tools. The plug connection between the mounting member and the holding member includes advantageously prestressed tongues on one of the members and respective recesses on the other member through which the prestressed tongues can extend, so that the rotation of the holding member relative to the mounting member about the axis of rotation of the block connection leads to engagement or disengagement of these members relative to one another. The same rotary movement serves for engagement or disengagement of the holding member with the bearing piece.

In order to provide for separate disengaging positions between the holding member and the bearing piece, on the one hand, and the mounting member and the holding member, on the other hand, the separating position of the block connection and the holding position of the one projection of the holding member are angularly offset from one another, relative to the axis of rotation of the holding member.

Still another feature of the present invention resides in the fact that the above-mentioned angular offset has such a dimension that the separating position of the one projection of the holding member from the bearing piece is located between the separating position of the plug connection and the holding position of the one projection of the holding member. In such a construction it is attained that both separating positions namely the separating position of the plug connection and the separating position of the holding member and the bearing piece, do not coincide with one another. Thereby, the plug connection can be reliably mounted before insertion of the one projection of the holding member into the respective recess of the bearing piece, during the rotation of the holding member about the above-mentioned axis of rotation.

It is advantageous to utilize a bearing piece with two grooves which are located in one plane diametrically opposite at a distance from one another and have open sides facing toward one another. The mounting member with its tongue-shaped projection engages in one of these grooves, whereas the holding member with its tongue-shaped projection engages in the other groove of the bearing piece during the rotation. Thereby a wedge-like action is obtained which is favorable for strong and force transmitting connection and at the same time provides for readily releasable connection between the holding element and the bearing piece. The holding element in accordance with the present invention can be utilized in any desirable position on a wall, a ceiling, an inclined face, a supporting arm, a console, and the like in narrow places, in niches, etc. It allows the mounting and dismounting of the bearing piece or pieces in their fixed position without the utilization of auxiliary tools.

A further feature of the present invention resides in the fact that the rotatable holding member can be provided for mounting operations, with a gripping tongue. The holding member can be easily gripped by the gripping tongue, whereby the holding member itself can be concealed and only the gripping tongue can project outside. The gripping tongue has a known construction and is located, for example, during the engagement of all parts concealed behind one of the structural parts. In some cases the gripping tongue can be provided with a chamfer, an ear or the like, so that it can be engaged by a tipped counter member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 2:
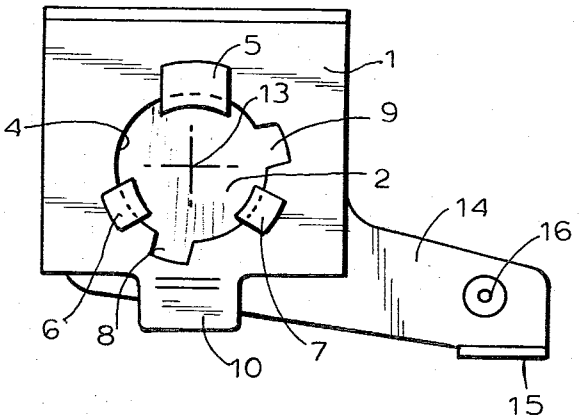
FIG. 2 is a front view of the holding element shown in FIG. 1.
Figure 3:
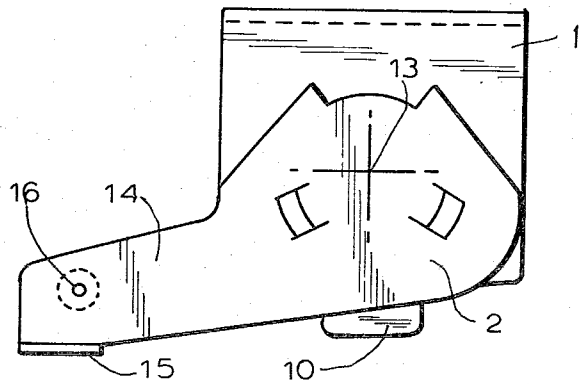
FIG. 3 is a rear view of the holding element shown in FIG. 1.

A holding element for mounting a bearing piece supporting a curtain and the like has a mounting member which is identified by reference numeral 1 and a holding member which is identified by reference numeral 2.

The mounting element 1 and the holding element 2 are connected with one another by a plug connection and are also connected with a bearing piece 3. The mounting member 1 has an opening 4, and the holding element 2 has tongue-like projections 5, 6 and 7 which have bent away portions. The projections 5, 6 and 7 of the holding member 2 can move through the opening 4 of the mounting member 1. The projections 5, 6, and 7 has tips which are arranged on a circumference having a greater diameter than that of the opening 4.

The mounting member 1 has in the region of the edge of the opening 4 two recesses 8 and 9 which have positions and dimensions corresponding to those of the projections 6 and 7 of the holding member 2. Thereby the projections 6 and 7 of the mounting element 1 can move through the recesses 8 and 9, and engage with the mounting member 1 upon rotation of the holding member 2 relative to the latter, so as to form the above-mentioned plug connection.

The holding element is connected with the bearing piece 3 to be mounted thereon as will be described hereinbelow. The holding member 2 of the holding element has the above-mentioned projection 5, whereas the mounting element 1 has a projection 10. The bearing piece, in turn, has two grooves 11 and 12 which extend in direction of elongation of the bearing piece 3 and are open toward one another. The grooves 11 and 12 are located in a common plane and diametrically opposite as considered relative to an axis of rotation 13 of the plug connection. The distance between the open sides of the grooves 11 and 12 is smaller than the diameter of the circumference on which the free ends of the projections 5 and 10 are located, the circumference having a center in the above-mentioned axis of rotation of the plug connection.

The holding position and the disengaging position of the plug connection in which the projections 6 and 7 are located in the region of the recesses 8 and 9, are located so that during the rotation of the holding member 2 relative the mounting member 1 about the axis 13 such free space is provided that the projection 5 can disengage from the bearing piece 3 without simultaneous disengagement of the plug connection. More particularly, the separating position of the plug connection and the holding position of the projection 5 of the holding member 2, are angularly offset from one another relative to the axis of rotation 13. The separating position of the projection 5 of the holding member from the bearing piece 3 is located between the above-mentioned separating position of the plug connection and the holding position of the projection 5 of the holding member 2.

Figure 1:
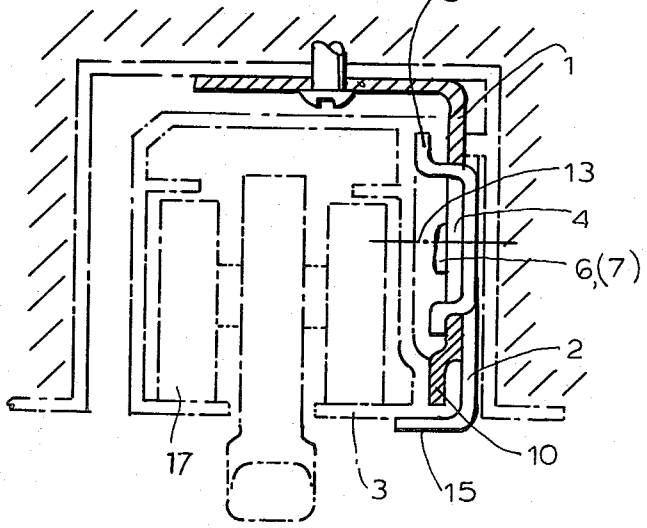
FIG. 1 is a view showing a section of a holding element in accordance with the present invention.

For making easier the mounting work and allowing the concealed arrangement of the bearing piece 3, a gripping tongue 14 is provided on the holding member 2. The entire holding element can be located in a niche, as shown in FIG. 1, and in the engaging position only a small chamfer 15 of the gripping tongue 14 remains visible. If necessary, the chamfer 15 can be engaged by a tipped counter member for dismounting purposes. In order to prevent unintentional displacement of the gripping tongue 14 to its dismounting position, for example, because of its weight during overhead arrangement, a raised part formed as an arresting point 16 is arranged on the gripping tongue. This raised part is inserted in a depression or the like in the mounting element 1 or vice versa.

Figure 4:
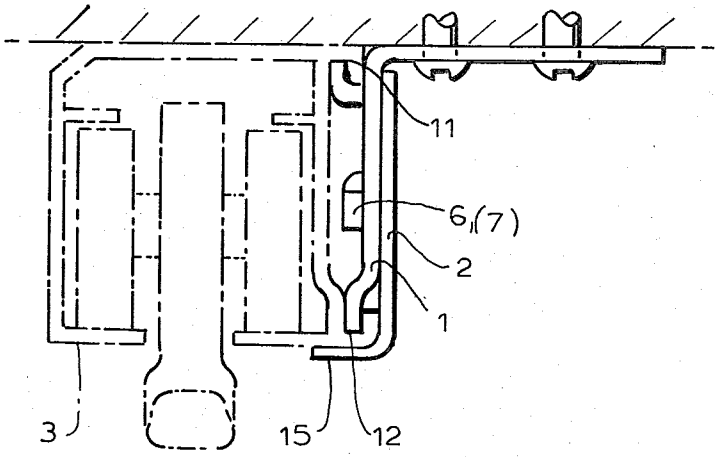
FIGS. 4 and 5 are side views of holding elements in accordance with two further embodiments of the present invention.
Figure 5:
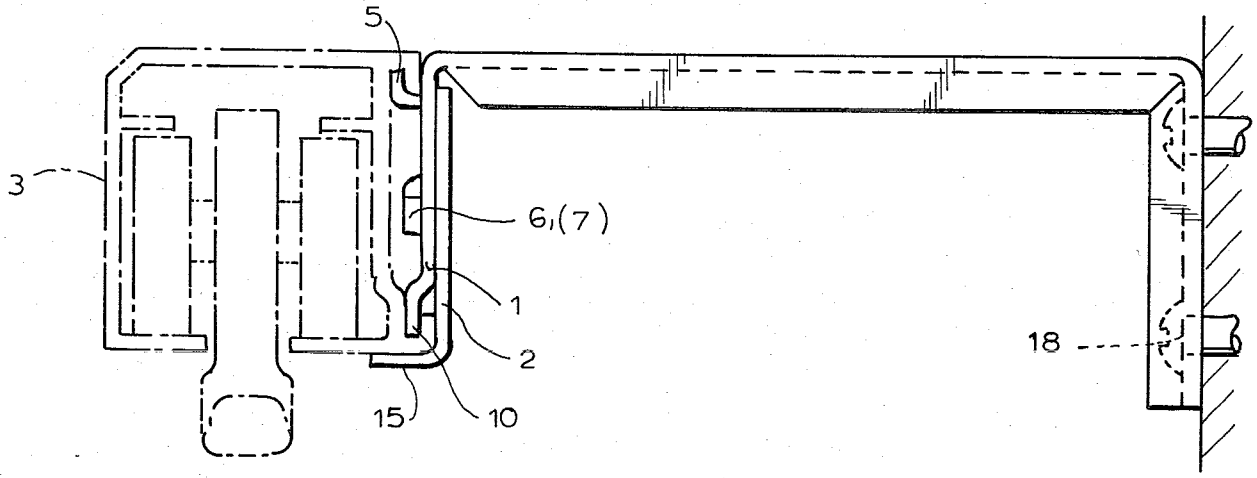

The holding element is shown in the drawing in connection with the bearing piece 3 for a travelling carriage 17, for example, for lamellas of a vertical The mounting member 1 is connected with a support, for example, by connecting means such as mounting screws 18 as shown in the drawing. The mounting member 1 may have different constructions, in dependence upon a support to which it is to be connected. As shown in FIG. 1, the upper leg of the mounting member 1 is bent inwardly of the holding member 2 and into the niche. FIG. 4 shows the upper leg of the mounting element 1 is bent outwardly of the holding member 2 and connected by the screws to a ceiling. FIG. 5 shows the mounting element 1 which, in addition to the upper leg has a second vertical leg which is spaced in a horizontal direction from the first vertical leg connectable with the holding member 2. The second vertical leg of the mounting member 1 is connected by screws with a vertical wall so that the holding element is actually located at a distance from the wall.

It will be understood that each of the elements described above, or two or more together, may also find a useful application in other types of constructions differing from the types described above.

While the invention has been illustrated and described as embodied in a holding element for a bearing piece supporting a curtain and the like it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A holding element for mounting a bearing piece which has at least two recesses and supports a curtain and the like, the holding element comprising a holding member arranged to hold a bearing piece; a mounting member arranged to mount the bearing piece on a support; a plug connection connecting said holding member and said mounting member and having an axis of rotation; and means for connecting said holding member and said mounting member with the bearing piece, said connecting means including at least two projections of which one projection is arranged on said holding member and engageable in one of the recesses of the bearing piece, whereas the other of said projections is arranged on said mounting member diametrically opposite to said one projection and engageable in the other of the recesses of the bearing piece.

2. A holding element as defined in claim 1, wherein said plug connection has a separating position, said one projection of said holding member being arranged so that it has a holding position which is angularly offset from said separating position of said plug connection, relative to said axis of rotation.

3. A holding element as defined in claim 2, wherein said one projection of said holding member is arranged so that it has a separating position from the bearing piece, located between said separating position of said plug connection and said holding position of said one projection of said holding member.

4. A holding element as defined in claim 1, wherein said plug connection is activated and deactivated by rotation of said holding member relative to said mounting member about said axis of rotation; and further comprising means for rotating said holding member relative to said mounting member.

5. A holding element as defined in claim 4, wherein said rotating means including a gripping tongue connected with said holding member.

6. A holding element as defined in claim 1, wherein said plug cconnection includes two slots provided in one of said members, and two further projections provided on the other of said members and arranged so that they can extend through said slots of said one member and engage with the latter upon rotation of said holding member relative to said mounting member about said axis of rotation.

7. A holding element as defined in claim 1, wherein said plug connection includes at least two slots provided in said mounting member, and at least two further projections provided on said holding member and arranged so that they can extend through said slots of said mounting member and engage with the latter upon rotation of said holding member relative to said mounting member about said axis of rotation.

8. A holding element as defined in claim 7, wherein said further projections of said holding member are angularly offset relative to one another and to said one projection of the same, relative to said axis of rotation.

9. A holding element as defined in claim 7, wherein said plug connection is activated and deactivated by rotation of said holding member relative to said mounting member; and further comprising means for rotating said holding member relative to said mounting member and including a gripping tongue connected with said holding member, said holding member having a body part on which said one projection, said two further projections, and said gripping tongue are arranged so as to form together a one-piece member.

10. A holding element as defined in claim 1; and further comprising means for connecting said mounting member with the support.

* * * * *